US005958661A

United States Patent [19]

Rieger et al.

[11] Patent Number: 5,958,661

[45] Date of Patent: Sep. 28, 1999

[54] PHOTOGRAPHIC ELEMENT WITH TOP BLUE LIGHT SENSITIVE LAYER

[75] Inventors: John B. Rieger; Alphonse D. Camp; Michael R. Roberts, all of Rochester; Thomas A. Chuhta, Pittsford, all of N.Y.

[73] Assignee: Eastman Kodak Company, Rochester, N.Y.

[21] Appl. No.: 08/892,752

[22] Filed: Jul. 15, 1997

[51] Int. Cl.[6] ..... G03C 1/08; G03C 7/26; G03C 7/32

[52] U.S. Cl. ..... 430/543; 430/502; 430/503; 430/558; 430/557; 430/567; 430/523; 430/627; 430/551

[58] Field of Search ..... 430/543, 558, 430/557, 567, 502, 503, 523, 627, 551

[56] References Cited

U.S. PATENT DOCUMENTS

| | | | |
|---|---|---|---|
| 4,102,688 | 7/1978 | Sugiyama et al. | 430/591 |
| 4,724,198 | 2/1988 | Yamada et al. | 430/506 |
| 4,740,454 | 4/1988 | Deguchi et al. | 430/567 |
| 4,748,100 | 5/1988 | Umemoto et al. | 430/505 |
| 4,752,558 | 6/1988 | Shimura et al. | 430/505 |
| 4,777,122 | 10/1988 | Beltramini | 430/502 |
| 4,816,378 | 3/1989 | Powers et al. | 430/301 |
| 4,888,272 | 12/1989 | Kishida et al. | 430/567 |
| 4,954,429 | 9/1990 | Urata | 430/505 |
| 5,350,664 | 9/1994 | Simons | 430/503 |
| 5,601,967 | 2/1997 | Brust et al. | 430/507 |
| 5,736,303 | 4/1998 | McSweeney et al. | 430/558 |

FOREIGN PATENT DOCUMENTS 0 573 761 A1 12/1993 European Pat. Off. .

OTHER PUBLICATIONS

Fumihiko, Japanese Journal of Paper Technology, 39(1), 1996, pp. 12–15.

Research Disclosure 23507, Nov. 1983, pp. 343–344.

*Primary Examiner*—Geraldine Letscher
*Attorney, Agent, or Firm*—Paul A. Leipold

[57] ABSTRACT

The invention relates to a color photographic element comprising a red light sensitive layer comprising a cyan dye forming coupler, a green light sensitive layer comprising a magenta dye forming coupler, a blue light sensitive layer comprising a yellow dye forming coupler, wherein said magenta dye forming coupler comprises wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$, and wherein said blue light sensitive layer is the light sensitive layer nearest the top of the photographic element and contains an emulsion comprising greater than 90 percent silver chloride.

13 Claims, No Drawings

PHOTOGRAPHIC ELEMENT WITH TOP BLUE LIGHT SENSITIVE LAYER

FIELD OF THE INVENTION

The invention relates to a method of providing improved performance of a multilayer color photographic element. More particularly, the invention relates to providing a green light sensitive magenta dye forming layer containing a pyrazoloazole dye forming coupler in a layer arrangement which places the blue light sensitive layer above the green light sensitive layer and the red light sensitive layer.

BACKGROUND OF THE INVENTION

Current color silver halide display materials utilize three color forming layers comprised of a red sensitive cyan dye forming layer, a green light sensitive magenta dye forming layer and a blue light sensitive yellow dye forming layer. In order to increase performance of color silver halide display materials in digital printers, there is a desire to have higher gamma at sub-microsecond exposure times in all three color records. Due to the large grain size of the blue light sensitive emulsion, the location of conventionally designed blue light sensitive yellow dye forming layers, and the high intensity reciprocity performance of conventionally sensitized blue light sensitive emulsions, the gamma of the blue light sensitive color record can be a limiting factor. These effects are especially evident in areas of high dye density, that is in the shoulder and Dmax (area of maximum density) regions. For instance, in the case of the blue light sensitive layer, a low shoulder would lead to black areas going blue and yellow colors desaturating.

One common way to increase gamma is increase the silver coverage of the emulsion. However, increased silver causes a number of problems. In particular, higher silver coverage leads to reduction in develop ability. This results in a lowering of neutral gamma for a given silver coverage and for a given time of development, or increased process sensitivity.

A further effect of using high coverage of emulsion is a deleterious loss of color purity. Typically, color photographic elements contain Dox scavenging interlayers (otherwise known as anticolor-mixing layers) to prevent interlayer color contamination. In the case of large grained emulsions, the scavenging layer may be increased in thickness or in concentration of the scavenging component in order to prevent formation of unwanted dye in adjacent layers. This also results in materials being wasted, since no dye is formed as a result of this process. In some instances, the very large grained emulsions produce a local concentration of Dox (oxidized developer) that is too high to be completely used by the appropriate coupler and/or scavenged by an anticolor mixing agent. For instance, in the case of large grained emulsions used in the blue layer, this can result in the formation of magenta colored spots in the photographic print from reaction of Dox formed in the blue layer with magenta coupler situated in the green layer.

When exposing conventional photographic materials by digital imaging there is a tendency for the images to have a defect commonly referred to as fringing which is a loss of image sharpness. This defect is most apparent at the edges of white areas of the prints bordering areas of higher density. Therefore there is a need to minimize fringing by silver halide materials exposed by digital means.

U.S. Pat. Nos. 5,066,575, 5,250,400, and 5,023,170 describe the pyrazoloazole type coupler class.

U.S. Pat. No. 4,404,274 describes the ketomethylene coupler class.

PROBLEM TO BE SOLVED BY THE INVENTION

There is a need for photographic materials that when digitally exposed will provide saturated colors, particularly in the yellow dye forming layer and also provide sharp images without fringing.

SUMMARY OF THE INVENTION

It is an object of this invention to overcome the disadvantages of prior photographic elements when digitally exposed.

It is an object of this invention to provide a color silver halide display material which exhibits less fringing when exposed in digital printers and processed conventionally.

It is a further object to provide a photographic element with has higher transmission densities, especially in the shoulder and Dmax regions.

In addition, it is an object of this invention to provide a photographic element in which there is a reduced propensity for color contamination.

These and other objects of the invention generally accomplished by a color photographic element comprising a red light sensitive layer comprising a cyan dye forming coupler, a green light sensitive layer comprising a magenta dye forming coupler, a blue light sensitive layer comprising a yellow dye forming coupler, wherein said magenta dye forming coupler comprises

MAGENTA-1

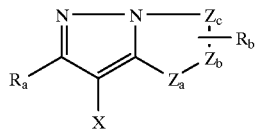

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$, and wherein said blue light sensitive layer is the light sensitive layer nearest the top of the photographic element and contains an emulsion comprising greater than 90 percent silver chloride.

ADVANTAGEOUS EFFECTS OF THE INVENTION

The invention provides a photographic element that when digitally exposed provides a saturated image in high density areas and is substantially free of fringing in low density areas bordering high density areas.

DETAILED DESCRIPTION OF EMBODIMENTS OF THE INVENTION

The invention provides numerous advantages over prior photographic elements and practices. The elements of the invention may be digitally exposed at time of between $1\times10^{-5}$ and $1\times10^{-8}$ seconds by digital exposing devices. When digitally exposed they have well saturated colors in high density areas and exhibit minimal fringing at the borders of low density areas. The product exhibits improved develop ability. The improved developability allows the processor to fully develop the photographic element under a range of developing conditions. The process therefore is more robust and will result in high quality images even though there are slight variations in the chemical compositions, time of development, or temperature of the processing solutions.

Another advantage of the invention is that the photographic elements have improved color purity in the yellow color record. There is less contamination of the yellow dye caused by oxidized developer reacting with coupler in adjacent layers. Further, the yellow image dye formed from the particular yellow dye forming coupler of the invention provides less inherent green light absorption resulting in a purer yellow hue.

As used herein the terms "upper side", "upper", "top", or "surface" all refer to the side of the coating from which the exposure is made. The term "top layer" refers to the layer farthest from the support. The terms "lower" and "bottom" refer to the layers closer to the support and to layers further away from the exposure or top side. The term "above" refers to a direction farther from the support. The term "shoulder density" refers to the density at 0.6 log exposure units above the speed point which is defined as the log exposure for a density of 0.8.

The use of pyrazoloazole magenta dye forming couplers allows silver coverage reduction in the green light sensitive magenta dye forming layer without any reduction in magenta gamma. This reduction in magenta silver coverage allows an increase in silver coverage in the blue light sensitive yellow dye forming layer without increasing total silver coverage, which increases yellow gamma and improves performance in a digital exposing device. In this way, total silver coverage is kept constant, while providing an advantage in yellow gamma. It is important to keep total silver coverage low, in order to keep cost low and maintain acceptable developability and bleachability. Total silver coverage of all imaging records is typically kept below 2.0 g/m$^2$.

While increasing the silver coverage in the blue light sensitive layer increases yellow layer gamma, the yellow shoulder density is further improved by utilizing the yellow coupler Y-5. At the same time, yellow coupler Y-5 improves the color purity of the yellow dye.

While increasing the silver coverage and utilizing the yellow coupler Y-5 in the blue light sensitive layer improves yellow gamma and yellow shoulder density, further improvement can be achieved by placing the blue light sensitive layer above the green and red light sensitive layers. The blue light sensitive emulsion is typically larger than either the red or green light sensitive emulsion. This makes the blue light sensitive emulsion less developable than either the red or green light sensitive emulsion. Placing the largest grain size emulsion on top results in a developability improvement in the photographic element. A suitable ratio of edge length of the blue-light sensitive emulsion to each of the edge length of the red light sensitive emulsion and the edge length of the green light sensitive emulsion is greater than 1.0. A ratio of greater than 1.5 is preferred for best photographic performance.

Placing the blue light sensitive layer above the green light and red light sensitive layers also reduces the blue light sensitivity of the green light and red light sensitive layers. This improves color reproduction of product exposed in devices which are susceptible to unwanted exposure of the red light and green light sensitive layers to blue light.

A typical multicolor photographic element comprises a support bearing a cyan dye image forming layer comprised of at least one red light sensitive silver halide emulsion having associated therewith at least one cyan dye-forming coupler, a magenta dye image forming layer comprising at least one green light sensitive silver halide emulsion having associated therewith at least one magenta dye-forming coupler, and a yellow dye image forming layer comprising at least one blue-sensitive silver halide emulsion having associated therewith at least one yellow dye-forming coupler. The element can contain additional layers, such as filter layers, interlayers, overcoat layers, subbing layers, and the like.

In the following discussion of suitable materials for use in the emulsions and elements that can be used in conjunction with this invention, reference will be made to *Research Disclosure*, September 1994, Item 36544, published by Kenneth Mason Publications, Ltd., Dudley House, 12 North Street, Emsworth, Hampshire P010 7DQ, England, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

The silver halide emulsions employed in these photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

Further, it would be advantageous to practice elements of the invention in conjunction with the materials disclosed in an article entitled "Typical and Preferred Color Paper, Color Negative, and Color Reversal Photographic Elements and Processing" which was published in *Research Disclosure*, February 1995, Volume 370. In particular, Sections I–XIII, XV–XVIII, and XXIIIA are especially relevant, and are hereby incorporated by reference.

Any photographic coupler known to the art can be used in conjunction with elements of the invention. Suitable couplers are described in *Research Disclosure*, Item 36544, Section X. In addition, the structures of particularly preferred couplers can be found in an article entitled "Typical and Preferred Color Paper, Color Negative, and Color Reversal Photographic Elements and Processing" which was published in *Research Disclosure*, February 1995, Volume 370, Section II.

The magenta coupler utilized in the invention may be any magenta coupler of the following structure:

MAGENTA-1

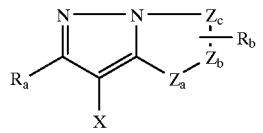

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$.

Preferred magenta couplers are 1H-pyrazolo[5,1-c]-1,2,4-triazole and 1H-pyrazolo[1,5-b]-1,2,4-triazole. Examples of 1H-pyrazolo[5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo[1,5-b]-1,2,4-triazoles can be found in European Patent applications 176,804; 177,765; U.S Pat. Nos. 4,659,652; 5,066,575; and 5,250,400.

In particular, pyrazoloazole magenta couplers of general structures PZ-1 and PZ-2 are especially preferred:

PZ-1

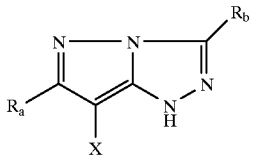

-continued

PZ-2

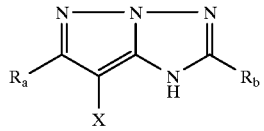

wherein $R_a$, $R_b$, and X are as defined for MAGENTA-1.

Particularly preferred arc the two-equivalent versions of magenta couplers PZ-1 and PZ-2 wherein X is not equal to a hydrogen. This is the case because of the advantageous drop in silver required to reach the desired density in the print element.

Typical magenta couplers that may be used in the inventive photographic element are shown below.

M-1

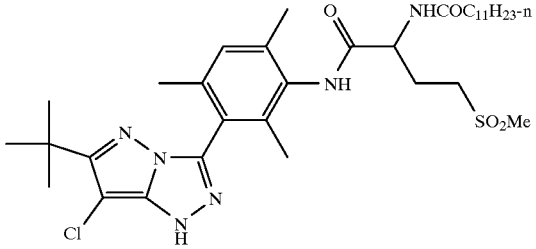

M-2

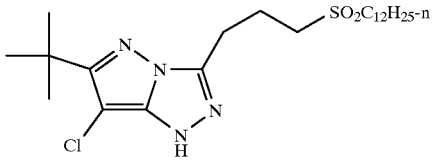

M-3

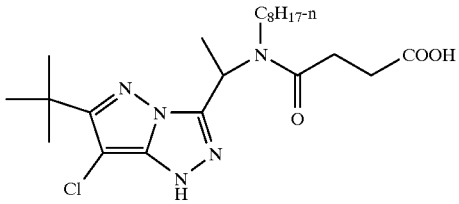

M-4

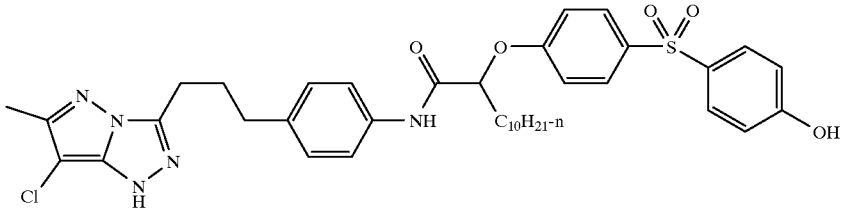

-continued

M-5

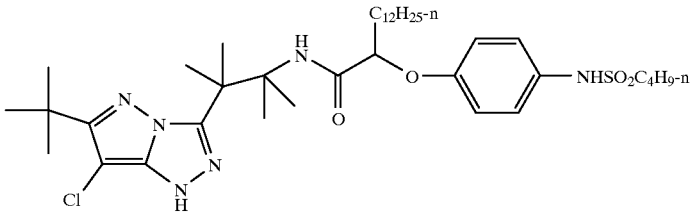

M-6

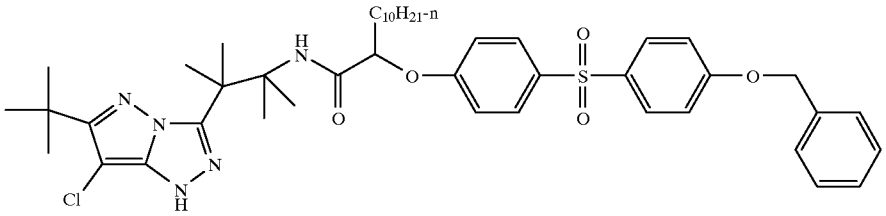

M-7

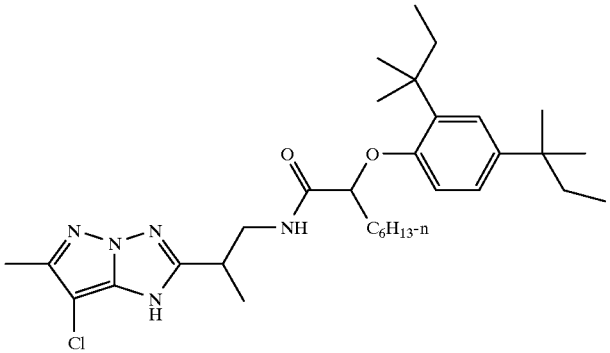

M-8

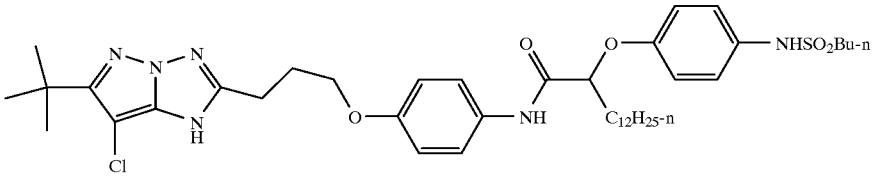

M-9

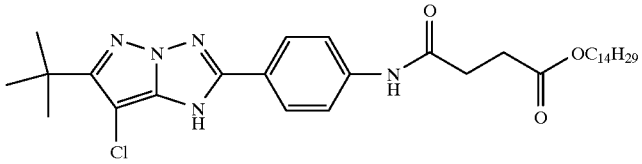

The most preferred magenta coupler is

M-2

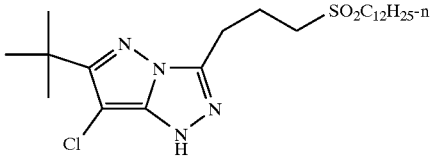

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

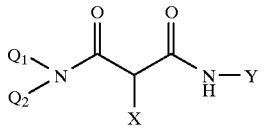

YELLOW-2

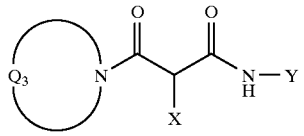

YELLOW-3

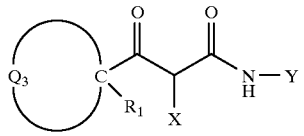

YELLOW-4

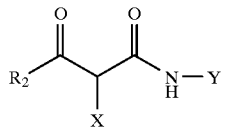

YELLOW-5

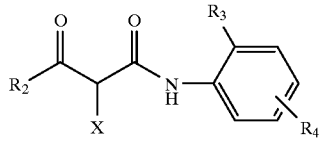

wherein $R_1$, $R_2$, $R_3$, $R_4$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group. Preferred yellow couplers for use in elements of the invention are represented by YELLOW-4, wherein $R_2$ represents a tertiary alkyl group, Y represents an aryl group, and X represents an aryloxy or N-heterocyclic coupling-off group.

The most preferred yellow couplers are represented by YELLOW-5, wherein $R_2$ represents a tertiary alkyl group, $R_3$ represents a halogen or an alkoxy substituent, $R_4$ represents a substituent and X represents a N-heterocyclic coupling-off group because of their good development and desirable color.

Even more preferred are yellow couplers are represented by YELLOW-5, wherein $R_2$, $R_3$ and $R_4$ are as defined above, and X is represented by the following formula:

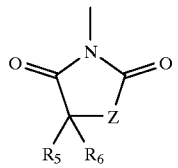

wherein Z is oxygen of nitrogen and $R_5$ and $R_6$ are substituents. Most preferred are yellow couplers wherein Z is oxygen and $R_5$ and $R_6$ are alkyl groups.

Typical yellow couplers that may be used in the inventive photographic element are shown below.

Y-1

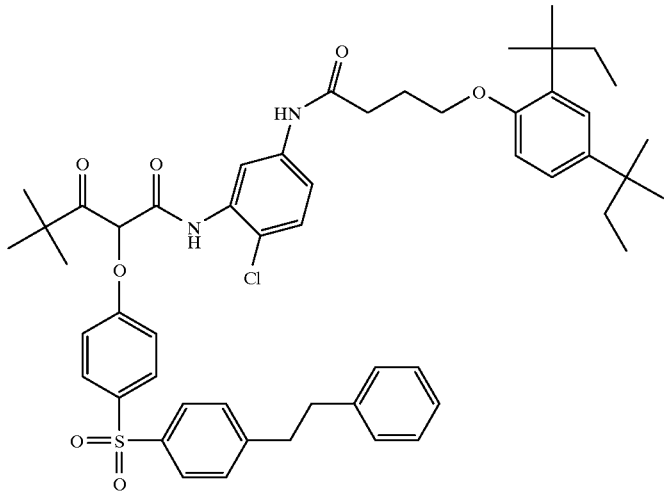

-continued
Y-2
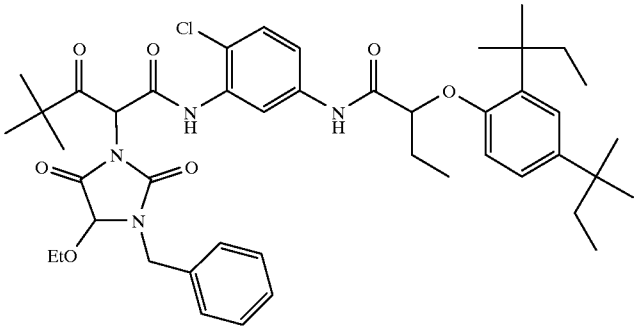
Y-3
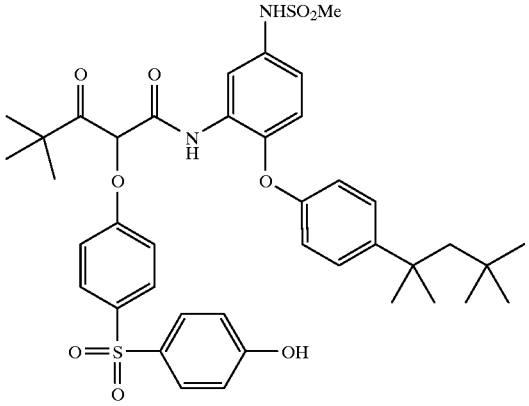
Y-4
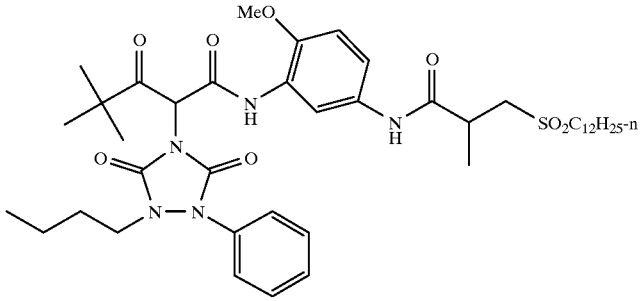
Y-5
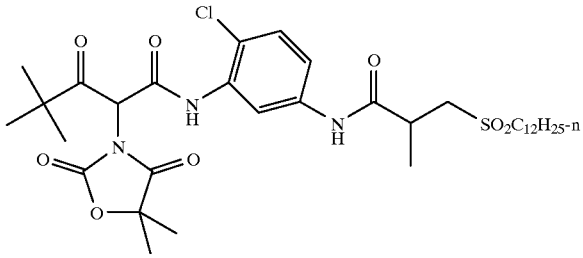

-continued
Y-6
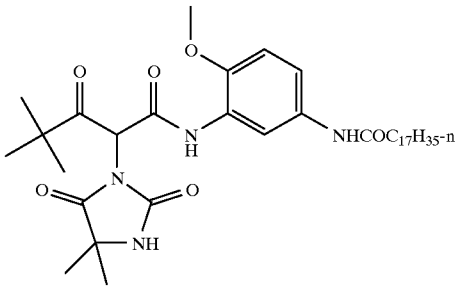
Y-7
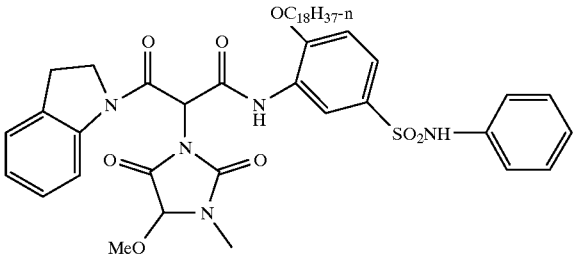
Y-8
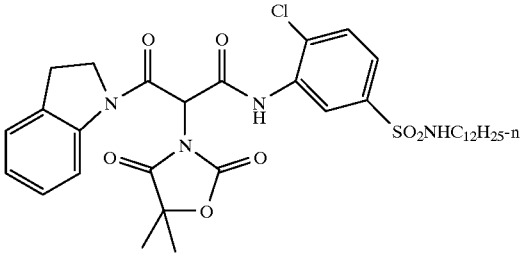
Y-9
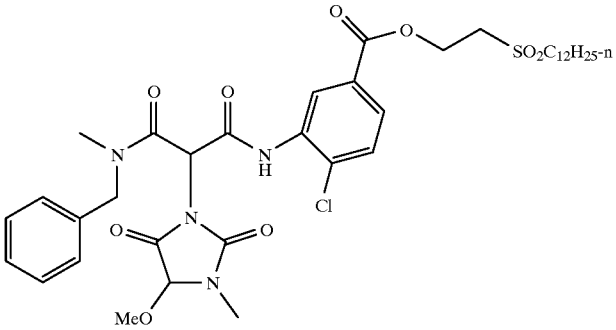
Y-10
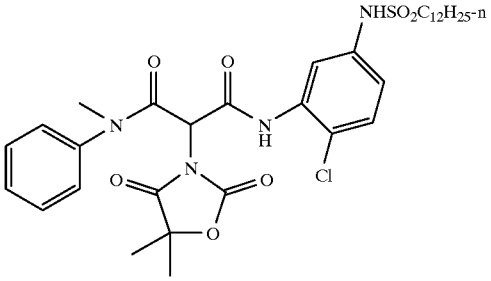

-continued

Y-11

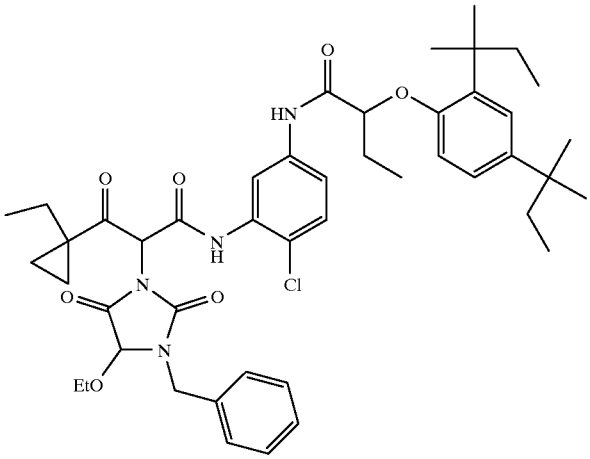

To control the migration of various components, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arylsulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Polymer containing dispersions of yellow photographic couplers have been employed in color print materials, as described in U.S. Pat. No. 4,857,449. Other methods for preparing polymer-containing dispersions of dye-forming couplers are described in U.S. Pat. Nos. 4,939,077; 4,203,716; and 4,840,885. Commonly, these dispersions are prepared from a solution of a coupler, an optional high-boiling solvent, an oil-soluble but water-insoluble polymer, and a volatile organic solvent, which solution is then emulsified and dispersed in an aqueous solution, often comprising water, a hydrophilic colloid such as gelatin, and a surfactant. Other methods describe the formation of loaded latex polymer dispersions using water-miscible or volatile organic solvent. We have also recently discovered that useful photographic coupler dispersions can be prepared by forming an loaded polymer latex dispersion, prepared either by high-shear mixing of a liquid oil phase with a latex-containing aqueous solution, or in some cases by combining a dispersion of a photographic coupler that is free of volatile organic solvent with a latex polymer, with sufficient surfactant and sufficient time to cause formation of a loaded latex dispersion. One of the main advantages of polymer-containing dispersions described in the prior art have included image preservability to heat and light, although other advantages in manufacturing processes, physical performance of the photographic element, and sensitometric performance have been reported.

Polymer containing dispersions used in the elements of the invention may be prepared by emulsifying a mixed oil solution comprising polymer and the photographically useful compounds desired in the dispersion, as described in U.S. Pat. Nos. 3,619,195 and 4,857,449.

Polymer-containing dispersions used in the elements of the invention may also be prepared as loaded latex dispersions. These may be prepared according to at least three types of process. The first process, described in, for example, U.S. Pat. No. 4,203,716, involves dissolving the hydrophobic photographically useful compounds to be loaded in a volatile or water miscible auxiliary solvent, combining this solution with an aqueous solution containing a polymer latex, and diluting the dispersion with additional aqueous solution or evaporating the auxiliary solvent to cause loading to occur. A second, more preferred method for preparing loaded latex formulations is to subject an oil solution or an aqueous dispersion of an oil solution comprising photographically useful compounds, to conditions of high shear or turbulence, in the presence of a polymer latex, with sufficient shear to cause loading as described in U.S. Pat. No. 5,594,047, the disclosure of which is hereby incorporated by reference. A third possible way to prepare some loaded latex formulations is to simply combine a polymer latex with a dispersed oil solution, such that the oil solution and latex are miscible, in the presence of surfactant, for a sufficient time before the dispersion is coated for loading to occur as described in U.S. Pat. No. 5,558,980, the disclosure of which is hereby incorporated by reference in its entirety.

Polymers used in the invention are preferably water-insoluble, and sufficiently hydrophobic to be incorporated as components of the hydrophobic dispersed phase of the dispersions used in the elements of the invention. The polymers may be prepared by bulk polymerization or solution polymerization processes. Especially preferred among possible polymerization processes is the free-radical polymerization of vinyl monomers in solution.

Preferred latex polymers of the invention include addition polymers prepared by emulsion polymerization. Especially preferred are polymers prepared as latex with essentially no water-miscible or volatile solvent added to the monomer. Also suitable are dispersed addition or condensation polymers, prepared by emulsification of a polymer solution, or self-dispersing polymers.

Especially preferred latex polymers include those prepared by free-radical polymerization of vinyl monomers in aqueous emulsion. Polymers comprising monomers which form water-insoluble homopolymers are preferred, as are copolymers of such monomers, which may also comprise monomers which give water-soluble homopolymers, if the overall polymer composition is sufficiently water-insoluble to form a latex.

Examples of suitable monomers include allyl compounds such as allyl esters (e.g., allyl acetate, allyl caproate, etc.); vinyl ethers (e.g., methyl vinyl ether, butyl vinyl ether, methoxyethyl vinyl ether, ethoxyethyl vinyl ether, chloroethyl vinyl ether, 1-methyl-2,2-dimethylpropyl vinyl ether, hydroxyethyl vinyl ether, diethylene glycol vinyl ether, dimethylaminoethyl vinyl ether, butylaminoethyl vinyl ether, benzyl vinyl ether, tetrahydrofurfuryl vinyl ether, etc.); vinyl esters (such as vinyl acetate, vinyl propionate, vinyl butyrate, vinyl isobutyrate, vinyl dimethyl propionate, vinyl ethyl butyrate, vinyl chloroacetate, vinyl dichloroacetate, vinyl methoxyacetate, vinyl phenyl acetate, vinyl acetoacetate, etc.); vinyl heterocyclic compounds (such as N-vinyl oxazolidone, N-vinylimidazole, N-vinylpyrrolidone, N-vinylcarbazole, vinyl thiophene, N-vinylethyl acetamide, etc.); styrenes (e.g., styrene, divinylbenzerie, methylstyrene, dimethylstyrene, ethylstyrene, isopropylstyrene, sodium styrenesulfonate, potassium styrenesulfinate, butylstyrene, hexylstyrene, cyclohexylstyrene, benzylstyrene, chloromethylstyrene, trifluoromethylstyrene, acetoxymethylstyrene, acetoxystyrene, vinylphenol, (t-butoxycarbonyloxy)styrene, methoxystyrene, 4-methoxy-3-methylstyrene, dimethoxystyrene, chlorostyrene, dichlorostyrene, trichlorostyrene, bromostyrene, iodostyrene, fluorostyrene, methyl vinylbenzoate ester, vinylbenzoic acid, etc.); crotonic acids (such as crotonic acid, crotonic acid amide, crotonate esters (e.g., butyl crotonate, etc.)); vinyl ketones (e.g., methyl vinyl ketone, etc ); olefins (e.g., dicyclopentadiene, ethylene, propylene, 1-butene, 5,5-dimethyl-1-octene, etc.); itaconic acids and esters (e.g., itaconic acid, methyl itaconate, etc.), other acids such as sorbic acid, cinnamic acid, methyl sorbate, citraconic acid, chloroacrylic acid mesaconic acid, maleic acid, fumaric acid, and ethacrylic acid; halogenated olefins (e.g., vinyl chloride, vinylidene chloride, etc.); unsaturated nitriles (e.g., acrylonitrile, etc.); acrylic or methacrylic acids and esters (such as acrylic acid, methyl acrylate, methacrylic acid, methyl methacrylate, ethyl acrylate, butyl acrylate, butyl methacrylate, 2-hydroxyethyl methacrylate, 2-acetoacetoxyethyl methacrylate, sodium-2-sulfoethyl acrylate, 2-aminoethylmethacrylate hydrochloride, glycidyl methacrylate, ethylene glycol dimethacrylate, etc.); and acrylamides and methacrylamides (such as acrylamide, methacrylamide, N-methylacrylamide, N,N-dimethylacrylamide, N-isopropylacrylamide, N-s-butylacrylamide, N-t-butylacrylamide, N-cyclohexylacrylamide, N-(3-aminopropyl) methacrylamide hydrochloride, N-(3-dimethylaminopropyl) methacrylamide hydrochloride, N,N-dipropylacrylamide, N-(1,1-dimethyl-3-oxobutyl)acrylamide, N-(1,1,2-trimethylpropyl)acrylamide, N-(1,1,3,3-tetramethylbutyl) acrylamide, N-(1-phthalamidomethyl)acrylamide, sodium N-(1,1-dimethyl-2-sulfoethyl)acrylamide, N-butylacrylamide, N-(1,1-dimethyl-3-oxobutyl) acrylamide, N-(2-carboxyethyl)acrylamide, 3-acrylamido-3-methylbutanoic acid, methylene bisacrylamide, etc.).

Specific examples of useful polymers and polymer latex materials are given below:

P-1 Poly(N-tert-butylacrylamide)
P-2 Poly(N-cyclohexylamide)
P-3 Poly(N-sec-butylacrylamide)
P-4 Poly(N-( 1,1,3,3-tetramethylbutyl)acrylamide)
P-5 Poly(N-(1,1,2-trimethylpropyl)acrylamide)
P-6 Poly(N-(1,1-dimethyl-3-oxobutyl)acrylamide)
P-7 Poly(N-(1-phthalimidomethyl)acrylamide)
P-8 Poly(N,N-di-n-propylacrylamide)
P-9 N-tert-butylacrylamide/2-hydroxyethylmethacrylate copolymer (80/20) (by weight, hereinafter the same)
P-10 N-tert-butylacrylamide/methylene bisacrylamide copolymer (98/2)
P-11 N-cyclohexylacrylamide/methylene bisacrylamide copolymer (98/2)
P-12 1,1-dimethyl-3-oxobutyl)acrylamide/methylene bisacrylamide copolymer (98/2)
P-13 Methyl acrylate/2-acrylamido-2-methylpropane sulfonic acid copolymer (96/4)
P-14 Methyl acrylate/2-acrylamido-2-methylpropane sulfonic acid copolymer (98/2)
P-15 Methyl acrylate/2-acrylamido-2-methylpropane sulfonic acid/2-acetoacetoxyethyl methacrylate copolymer (91/5/4)
P-16 Methyl acrylate/2-acrylamido-2-methylpropane sulfonic acid/ethylene glycol dimethacrylate copolymer (96/2/2)
P-17 Butyl acrylate/2-acrylamido-2-methylpropane sulfonic acid sodium salt/2-acetoacetoxyethyl methacrylate copolymer (90/6/4)
P-18 Butyl acrylate/2-acrylamido-2-methylpropane sulfonic acid/ethylene glycol dimethacrylate copolymer (90/6/4)
P-19 Butyl acrylate/styrene/methacrylamide/2-acrylamido-2-methylpropane sulfonic acid sodium salt copolymer (55/29/11/5)
P-20 Butyl acrylate/styrene/2-acrylamido-2-methylpropane sulfonic acid sodium salt copolymer (85/10/5
P-31 Poly(methylmethacrylate)
P-32 Glycidyl methacrylate/ethylene glycol dimethacrylate copolymer (95/5)
P-33 Poly(acrylonitrile)
P-34 Acrylonitrile/vinylidene chloride/acrylic acid copolymer (15/79/6)
P-35 Styrene/butyl methacrylate/2-sulfoethyl methacrylate sodium salt
copolymer (30/60/10)
P-36 Polystyrene
P-37 Poly(4-acetoxystyrene)
P-38 Poly(4-vinylphenol)
P-39 Poly(4-t-butoxycarbonyloxystyrene)
P-40 2-(2'-Hydroxy-5'-methacrylyloxyethylphenyl)-2H-benzotriazole/ethyl acrylate/2-acrylamido-2-methylpropane sulfonic acid sodium salt copolymer (74/23/3)
P-41 N-tert-butylacrylamide/3-acrylamido-3-methylbutanoic acid copolymer (99.5/0.5)
P-42 N-tert-butylacrylamide/3-acrylamido-3-methylbutanoic acid copolymer (99.0/1.0)
P-43 N-tert-butylacrylamide/3-acrylamido-3-methylbutanoic acid copolymer (98/2)
P-44 N-tert-butylacrylamide/3-acrylamido-3-methylbutanoic acid copolymer (96/4)
P-45 N-tert-butylacrylamide/3-acrylamido-3-methylbutanoic acid copolymer (92/8)
P-46 N-tert-butylacrylamide/methyl acrylate copolymer (25/75)
P-47 N-tert-butylacrylamide/methyl acrylate copolymer (50/50)
P-48 N-tert-butylacrylamide/methyl acrylate copolymer (75/25)
P-49 Poly(methyl acrylate)
P-50 Methyl methacrylate/methyl acrylate copolymer (75/25)
P-51 Methyl methacrylate/methyl acrylate copolymer (50/50)
P-52 Methyl methacrylate/methyl acrylate copolymer (25/75)

P-53 N-tert-butylacrylamide/2-acrylamido-2-methylpropane sulfonic acid sodium salt copolymer (98/2)

P-54 N-tert-butylacrylamide/2-acrylamido-2-methylpropane sulfonic acid sodium salt copolymer (99/1)

P-55 Methyl methacrylate/2-acrylamido-2-methylpropane sulfonic acid sodium salt copolymer (98/2)

P-56 N-tert-butylacrylamide/n-butyl acrylate copolymer (50/50)

Suitable free-radical initiators for the polymerization include, but are not limited to the following compounds and classes. Inorganic salts suitable as initiators include potassium persulfate, sodium persulfate, potassium persulfate with sodium sulfite, etc. Peroxy compounds which may be used include benzoyl peroxide, t-butyl hydroperoxide, cumyl hydroperoxide, etc. Azo compounds which may be used include azobis(cyanovaleric acid), azobis-(isobutyronitrile), 2,2'-azobis(2-amidinopropane) dihydrochloride, etc.

The support utilized in the photographic elements of the invention may be any suitable material. Suitable materials include paper, and opaque plastic sheets. A preferred material is transparent polyester sheets, particularly polyethylene terephthalate. The preferred sheets are about 7 mils thickness.

It has been found that the ultraviolet material is more effective if place more toward the surface of the photographic element. It is preferred that it be placed above the blue light sensitive layer rather than in lower interlayers.

It is understood throughout this disclosure that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any photographically useful substituents. Usually the substituent will have less than 30 carbon atoms and typically less than 20 carbon atoms. Typical examples of substituents include alkyl, aryl, anilino, carbonamido, sulfonamido, alkylthio, arylthio, alkenyl, cycloalkyl, and further to these exemplified are halogen, cycloalkenyl, alkinyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues.

In this invention, the presence of an interlayer containing an anticolor-mixing agent (antistain or oxidized developer scavenger) is preferred. Typically, these scavengers are ballasted to keep them in the layer in which they were coated. The scavengers work by reducing any excess oxidized developer back to the developer form. Anticolor-mixing agents include compounds such as derivatives of hydroquinones (e.g. see U.S. Pat. Nos. 2,336,327; 2,360,290; 2,403,721; 2,701,197; 2,728,659; and 3,700,453) aminophenols, amines, gallic acid, catechol, ascorbic acid, hydrazides (e.g. U.S. Pat. No. 4,923,787), sulfonamidophenols (e.g. U.S. Pat. No. 4,447,523), and non color-forming couplers.

It is also contemplated that the concepts of the discussion may be employed to obtain reflection color prints as described in *Research Disclosure*, November 1979, Item 18716, incorporated herein by reference. The photographic element may contain epoxy solvents (EP 164,961); ballasted chelating agents such as those in U.S. Pat. No. 4,994,359 to reduce sensitivity to polyvalent cations such as calcium; and stain reducing compounds such as described in U.S. Pat. Nos. 5,068,171, 5,096,805, and 5,126,234. The particular base material utilized may be any material conventionally used in silver halide color papers. Such materials are disclosed in *Research Disclosure*, September 1994, Item 36544, Section XV. It may be desired to coat the photographic element on pH adjusted support as described in U.S. Pat. No. 4,917,994. If desired, false sensitization, as described in Hahm in U.S. Pat. No. 4,902,609, can be used to provide added detail in color paper embodiments.

Due to a desire for rapid development and reduced impact on the environment, preferred emulsions for color display materials having a transparent or paper base of the invention are high in silver chloride. Typically, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. Bromide or iodide addition when forming the emulsion may come from a soluble halide source such as potassium iodide or sodium bromide or an organic bromide or iodide or an inorganic insoluble halide such as silver bromide or silver iodide. Soluble bromide is also typically added to the emulsion melt as a keeping addendum. It is specifically contemplated to use [100] tabular grain silver chloride emulsions, as disclosed in U.S. Pat. No. 5,320,938, in conjunction with elements of the current invention.

Color display elements typically contain less than 2.0 $g/m^2$ of total silver. Due to the need to decrease the environmental impact of color display processing, it is desired to decrease the amount of total silver used in the element as much as possible. Therefore, total silver levels of less than 1.3 $g/m^2$ are preferable, and levels of 1.1 $g/m^2$ are even more preferable. It is possible to reduce further the total silver used in the color photographic element to less than 0.20 $g/m^2$ by use of a so-called development amplification process whereby the incorporated silver is used only to form the latent image, while another oxidant, such as hydrogen peroxide, serves as the primary oxidant to react with the color developer. Such processes are well-known to the art, and are described in, for example, U.S. Pat. Nos. 4,791,048; 4,880,725; and 4,954,425; EP 487,616; International published patent applications Nos. WO 90/013,059; 90/013,061; 91/016,666; 91/017,479; 92/001,972; 92/005,471; 92/007,299; 93/001,524; 93/011,460; and German published patent application OLS 4,211,460.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. Elements of the invention can be processed by a method such as the RA-4 process of Eastman Kodak Company as is described in the British Journal of Photography Annual of 1988, pages 198–199.

Photographic color light-sensitive materials often utilize silver halide emulsions where the halide, for example chloride, bromide and iodide, is present as a mixture or combination of at least two halides. The combinations significantly influence the performance characteristics of the silver halide emulsion. As explained in Atwell, U.S. Pat. No. 4,269,927, silver halide with a high chloride content, that is, light-sensitive materials in which the silver halide grains are at least 80 mole percent silver chloride, possesses a number of highly advantageous characteristics. For example, silver chloride possesses less native sensitivity in the visible region of the spectrum than silver bromide, thereby permitting yellow filter layers to be omitted from multicolor photographic light-sensitive materials. However, if desired, the use of yellow filter layers should not be excluded from consideration for a light sensitive material. In fact, placing the blue light sensitive layer above the red and green light sensitive layers results in reduced blue light sensitivity in the red light and green light sensitive layers. Furthermore, high chloride silver halides are more soluble than high bromide silver halide, thereby permitting development to be achieved in shorter times. Furthermore, the release of chloride into the developing solution has less restraining action on development compared to bromide and this allows developing solutions to be utilized in a manner that reduces the amount of waste developing solution.

Processing a silver halide color photographic light-sensitive material is basically composed of two steps of 1) color development and 2) desilvering. The desilvering stage comprises a bleaching step to change the developed silver back to an ionic-silver state and a fixing step to remove the ionic silver from the light-sensitive material. The bleaching and fixing steps can be combined into a monobath bleach-fix step that can be used alone or in combination with the bleaching and the fixing step. If necessary, additional processing steps may be added, such as a washing step, a stopping step, a stabilizing step and a pretreatment step to accelerate development. The processing chemicals used may be liquids, pastes, or solids, such as powders, tablets or granules.

In color development, silver halide that has been exposed to light is reduced to silver, and at the same time, the oxidized aromatic primary amine color developing agent is consumed by the above mentioned reaction to form image dyes. In this process halide ions from the silver halide grains are dissolved into the developer, where they will accumulate. In addition the color developing agent is consumed by the afore-mentioned reaction of the oxidized color developing agent with the coupler. Furthermore, other components in the color developer will also be consumed and the concentration will gradually be lowered as additional development occurs. In a batch-processing method, the performance of the developer solution will eventually be degraded as a result of the halide ion build-up and the consumption of developer components. Therefore, in a development method that continuously processes a large amount of a silver halide photographic light-sensitive material, for example by automatic-developing processors, in order to avoid a change in the finished photographic characteristics caused by the change in the concentrations of the components, some means is required to keep the concentrations of the components of the color developer within certain ranges.

For instance, a developer solution in a processor tank can be maintained at a 'steady-state concentration' by the use of another solution that is called the replenisher solution. By metering the replenisher solution into the tank at a rate proportional to the amount of the photographic light-sensitive material being developed, components can be maintained at an equilibrium within a concentration range that will give good performance. For the components that are consumed, such as the developing agents and preservatives, the replenisher solution is prepared with the component at a concentration higher than the tank concentration. In some cases a material will leave the emulsions layers that will have an effect of restraining development, and will be present at a lower concentration in the replenisher or not present at all. In other cases a material may be contained in a replenisher in order to remove the influence of a materials that will wash out of the photographic light-sensitive material. In other cases, for example, the buffer, or the concentration of a chelating agent where there may be no consumption, the component in the replenisher is the same or similar concentration as in the processor tank. Typically the replenisher has a higher pH to account for the acid that is released during development and coupling reactions so that the tank pH can be maintained at an optimum value.

Similarly, replenishers are also designed for the secondary bleach, fixer and stabilizer solutions. In addition to additions for components that are consumed, components are added to compensate for the dilution of the tank which occurs when the previous solution is carried into the tank by the photographic light-sensitive material.

The following processing steps may be included in the preferable processing steps carried out in the method in which a processing solution is applied:

1) color developing→bleach-fixing→washing/stabilizing;
2) color developing→bleaching→fixing→washing/stabilizing;
3) color developing→bleaching→bleach-fixing→washing/stabilizing;
4) color developing→stopping→washing→bleaching→washing→fixing→washing/stabilizing;
5) color developing→bleach-fixing→fixing→washing/stabilizing;
6) color developing→bleaching→bleach-fixing→fixing→washing/stabilizing.

Among the processing steps indicated above, the steps 1) and 2) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

The color developing solution used with this photographic element may contain aromatic primary amine color developing agents, which are well known and widely used in a variety of color photographic processes. Preferred examples are p-phenylenediamine derivatives. They are usually added to the formulation in a salt form, such as the hydrochloride, sulfate, sulfite, p-toluene-sulfonate, as the salt form is more stable and has a higher aqueous solubility than the free amine. Among the salts listed the p-toluenesulfonate is rather useful from the viewpoint of making a color developing agent highly concentrated. Representative examples are given below, but they are not meant to limit what could be used with the present photographic element:

4-amino-3-methyl-N-ethyl-N-(β-hydroxyethyl)aniline sulfate,
4-amino-3-methyl-N-ethyl-N-(β-(methanesulfonamidoethyl)aniline sesquisulfate hydrate,
4-amino-N,N-diethylaniline hydrochloride,
4-amino-3-methyl-N,N-diethylaniline hydrochloride,
4-amino-3-β-(methanesulfonamido)ethyl-N,N-diethylaniline hydrochloride and
4-amino-N-ethyl-N-(2-methoxyethyl)-m-toluidine di-p-toluene sulfonic acid.

Among the above-mentioned color developing agents, 4-amino-3-methyl-N-ethyl-N-(β-(methanesulfonamidoethyl)aniline sesquisulfate hydrate preferably is used. There may be some instances where the above mentioned color developing agents may be used in combination so that they meet the purposes of the application.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 92/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

It has been found that the following is a preferred layer structure of the invention.

FIG. 1

| Conventional Structure | Inventive Structure |
|---|---|
| Overcoat | Overcoat |
| UV absorbing layer | UV absorbing layer |
| Red light sensitive layer | Blue light sensitive layer |
| Interlayer | Interlayer |
| Green light sensitive layer | Red or Green light sensitive layer |
| Interlayer | Interlayer |
| Blue light sensitive layer | Green or Red light sensitive layer |
| Support | Support |

In this invention, an interlayer is used below the blue light sensitive layer which is preferably loaded with oxidized developer scavenger, such as DOH. This interlayer may contain UV absorbing dyes. With a higher concentration of UV absorbing dye above the blue light sensitive layer, some of the UV absorbing dye can be removed from the interlayer. This allows more scavenger to be loaded into the interlayer, without impairing the gelatin matrix with non-matrixed organic components.

A diffuser layer may be added to the structure. This layer may contain titanium dioxide, or any material capable of diffusing light.

A pelloid layer may be added to the structure on the other side of the support relative to the imaging layers on the other side of the support relative to the imaging layers. This layer may contain light absorbing dyes or silver to provide halation protection, and may also contain enough gelatin to prevent curl.

The magnitude of the beneficial effects obtained by use of the invention are dependent on coupler reactivity, emulsion grain size, emulsion halide content, and the relative amounts of organic and inorganic materials used in the various layers, among other things.

Although any coupler can be used, as coupler reactivity goes up, the invention can be altered. Additionally, the advantages of this, invention are observed to be greater with increasing grain size of the blue light sensitive emulsion. Generally, blue light sensitive grain sizes are preferably in the range of 0.4 to 2.5 μm, and more preferably in the range of 0.5 to 2.0 μm. The most preferred grains are in the range of 0.6 to 1.5 μm as this gives the best speed and developability of a display element of the invention.

For the reasons mentioned above, silver halide emulsions with greater than 90 mole % chloride are preferred, and even more preferred are emulsions of greater than 95 mole % chloride. In some instances, silver chloride emulsions containing small amounts of bromide, or iodide, or bromide and iodide are preferred, generally less than 5.0 mole % of bromide less than 2.0 mole % of iodide. In addition, the inclusion of substantial amounts of bromide and/or iodide would tend to reduce the developability of the emulsion, and thereby reduce the magnitude of the inventive effect.

PHOTOGRAPHIC EXAMPLES

Example 1

Silver chloride emulsions were chemically and spectrally sensitized as is described below.

Blue Sensitive Emulsion (Blue EM-1, prepared similarly to that described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. The resultant emulsion contained cubic shaped grains of 0.76 μm in edge length. This emulsion was optimally sensitized by the addition of a colloidal suspension of aurous sulfide and heat ramped up to 60° C. during which time blue sensitizing dye BSD-4, 1-(3-acetamidophenyl)-5-mercaptotetrazcile and potassium bromide were added. In addition, iridium dopant was added during the sensitization process.

Green Sensitive Emulsion (Green EM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. The resultant emulsion contained cubic shaped grains of 0.30 μm in edge length. This emulsion was optimally sensitized by addition of a colloidal suspension of aurous sulfide, heat digestion, followed by the addition of iridium dopant, Lippmann bromide/1-(3-acetamidophenyl)-5-mercaptotetrazole, green sensitizing dye GSD-1 and 1-(3-acetamidophenyl)-5-mercaptotetrazole.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium dopant was added during the precipitation process. This emulsion was optimally sensitized by the addition of a colloidal suspension of aurous sulfide followed by a heat ramp, and further additions of 1-(3-acetamidophenyl)-5-mercaptotetrazole, iridium dopant, potassium bromide, and red sensitizing dye RSD-1.

Coupler dispersions were emulsified by methods well known to the art, and the following layers were coated on polyethylene terepthalate transparent sheet 7 mils in thickness. The gelatin layers were hardened with bis (vinylsulfonyl methyl) ether at 2.4% of the total gelatin weight.

| | g/m$^2$ |
|---|---|
| DF-1: Diffuser | |
| Gelatin | 2.3 |
| Titanium dioxide | 2.2 |
| GL-1: Green Sensitive Layer | |
| Gelatin | 2.0 |
| Green Sensitive Silver | 0.43 |
| M-2 | 0.86 |
| Dibutyl phthalate | 0.77 |
| Octadecyl 3,5-di-tert-butyl-4-hydroxyhydrocinnamnate | 0.09 |
| ST-8 | 0.34 |
| ST-21 | 0.34 |
| ST-22 | 0.58 |
| 1-Phenyl-5-mercaptotetrazole | 0.001 |
| DYE-2 | 0.006 |
| IL-1: Interlayer | |
| Gelatin | 0.75 |
| Dioctyl hydroquinone | 0.07 |
| Dibutyl phthalate | 0.19 |
| Disodium 4,5 Dihydroxy-*m*-benzenedisu1fonate | 0.07 |
| SF-1 | 0.01 |
| Irganox 1076 ™ | 0.01 |
| RL-1 Red Sensitive Layer | |
| Gelatin | 1.87 |
| Red Sensitive Silver (Red EM-1) | 0.65 |
| C-1 | 1.01 |
| Dibutyl phthalate | 0.99 |
| UV-2 | 0.65 |
| 2-(2-butoxyethoxy)ethyl acetate | 0.08 |
| Dioctyl hydroquinone | 0.013 |
| DYE-3 | 0.006 |
| BL-1: Blue Sensitive Layer | |
| Gelatin | 3.08 |
| Blue Sensitive Silver (Blue EM-1) | 0.75 |
| Y-1 | 2.15 |
| ST-6 | 0.52 |
| Dibutyl phthalate | 0.71 |
| 2-(2-butoxyethoxy)ethyl acetate | 0.60 |
| 2,5-Dihydroxy-5-methyl-3-(1-piperidinyl)-2-cyclopenten-1-one | 0.002 |
| 1-Phenyl-5-mercaptotetrazole | 0.0001 |
| DYE-1 | 0.02 |
| BL-2: Blue Sensitive Layer | |
| Gelatin | 3.08 |
| Blue Sensitive Silver (Blue EM-1) | 0.75 |
| Y-5 | 1.29 |
| P-54) | 1.29 |
| Dibutyl phthalate | 0.88 |
| 2,5-Dihydroxy-5-methyl-3-(1-piperidinyl)-2-cyclopenten-1-one | 0.002 |
| 1-Phenyl-5-mercaptotetrazole | 0.0001 |
| DYE-1 | 0.02 |
| UV-1: UV Interlayer | |
| Gelatin | 0.74 |
| UV-1 | 0.03 |
| UV-2 | 0.19 |
| Dioctyl hydroquinone | 0.055 |
| Dibutyl phthalate | 0.037 |
| 1,4-Cyclohexylenedimethylene bis(2-ethylhexanoate) | 0.037 |
| UV-2: UV Overcoat | |
| Gelatin | 0.51 |
| UV-1 | 0.023 |
| UV-2 | 0.13 |
| Dioctyl hydroquinone | 0.038 |
| Dibutyl phthalate | 0.026 |
| 1,4-Cyclohexylenedimethylene bis(2-ethylhexanoate) | 0.026 |
| S-1: SOC | |
| Gelatin | 1.35 |
| Methacrylate beads | 0.016 |
| Dioctyl hydroquinone | 0.013 |
| Dibutyl phthalate | 0.039 |
| SF-1 | 0.009 |
| SF-2 | 0.004 |

Structures

BSD-4

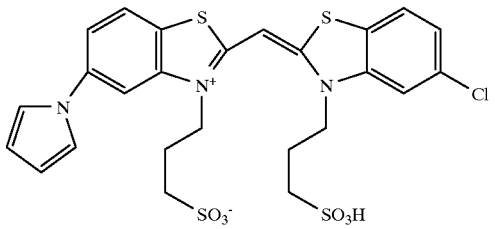

GSD-1

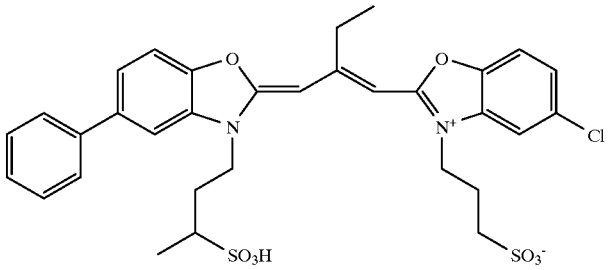

-continued
RSD-1
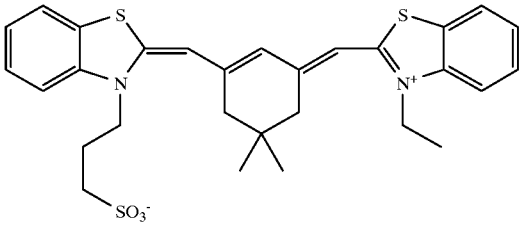
Y-1
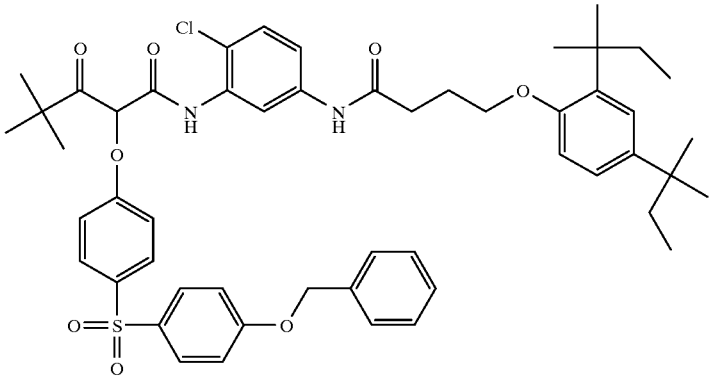
M-2
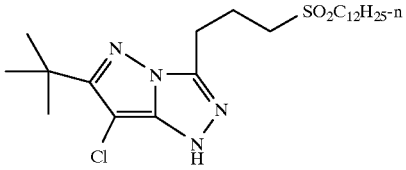
C-1
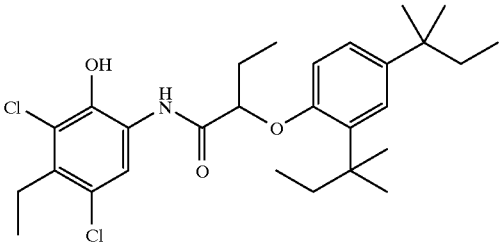
ST-6
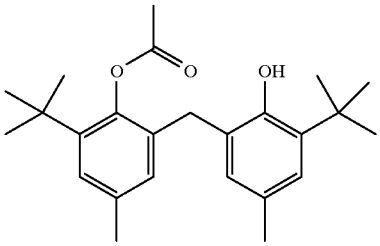
ST-8
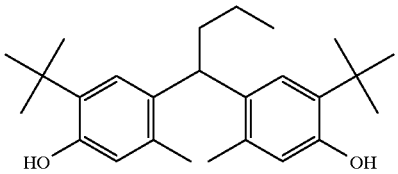

-continued
ST-16
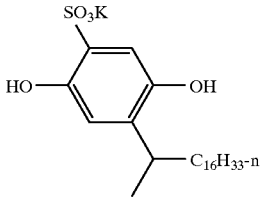
ST-21
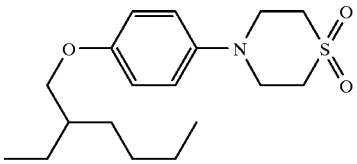
ST-22
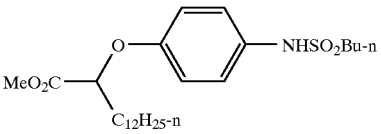
DYE-1
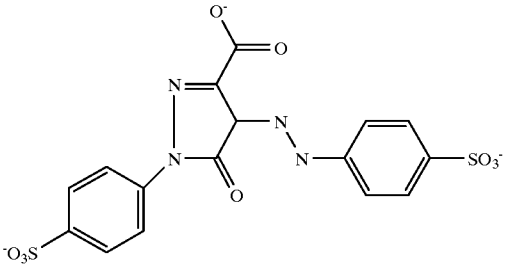
DYE-2
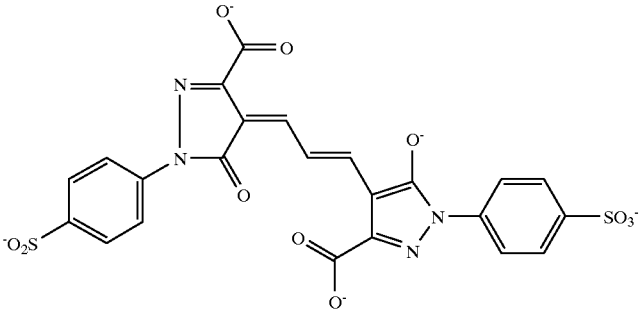
DYE-3
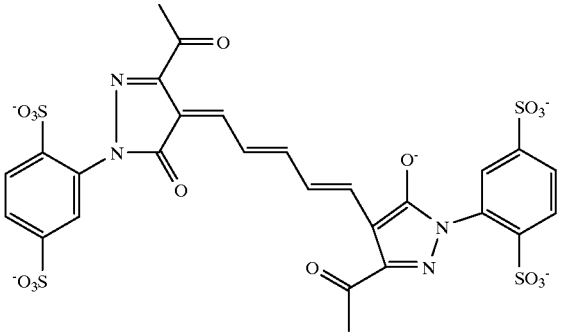

-continued

UV-1

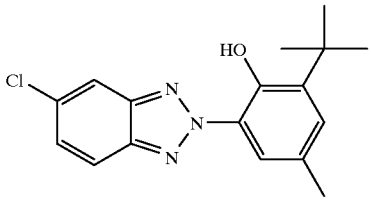

UV-2

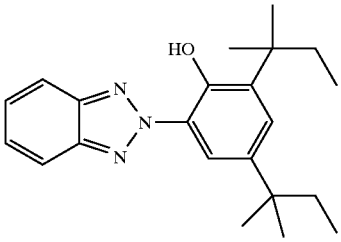

SF-1

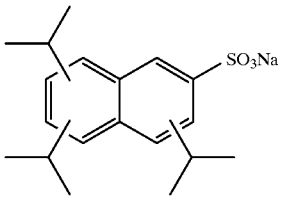

SF-2

$CF_3(CF_2)_7SO_3Na$

SF-12

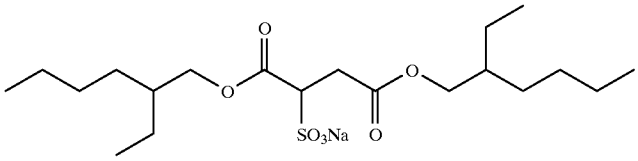

Coatings 1-1 through 1-3 were prepared according to the structure shown in Table 1.

TABLE 1

| Coating | 1-1 | 1-2 | 1-3 |
|---|---|---|---|
| Comment | Comparison | Comparison | Invention |
| SOC | S-1 | S-1 | S-1 |
| UV | UV-2 | UV-2 | UV-2 |
| | RL-1 | RL-1 | BL-2 |
| UV | UV-1 | UV-1 | UV-1 |
| | GL-1 | GL-1 | RL-1 |
| IL | IL-1 | IL-1 | IL-1 |
| | BL-1 | BL-2 | GL-1 |
| DF | DF-1 | DF-1 | DF-1 |

The coatings were given a red, green and blue stepped exposure and processed through the Kodak RA-4 process, described in the *British Journal of Photography Annual* of 1988, pp. 190–199, comprising the following processing solutions, times and temperatures to give the results shown in Table 2.

| | | |
|---|---|---|
| Developer | 110 sec | 35° C. |
| Bleach-Fix | 110 sec | 35° C. |
| Wash | 3 min, 40 sec | 33–34° C. |

TABLE 2

| Coating | Comment | Relative Red Shoulder Density | Relative Green Shoulder Density | Relative Blue Shoulder Density | Green Density at Blue Density of 2.80 | Red Density at Blue Density of 2.80 |
|---|---|---|---|---|---|---|
| 1-1 | Comparison | check | check | check | 0.68 | 0.35 |
| 1-2 | Comparison | 0.00 | +0.04 | +0.36 | 0.60 | 0.35 |
| 1-3 | Invention | −0.15 | +0.02 | +0.64 | 0.58 | 0.35 |

Green density at a blue density of 2.8 refers to the amount of green density as measured by Status A densitometry for a blue light exposure. Red density at a blue density of 2.8 refers to the amount of red density as measured by Status A densitometry for a blue light exposure. These are both measures of color purity.

As shown in the table, the inventive variation 1-3 has the highest blue shoulder density and the least amount of unwanted green density for a blue exposure.

In the inventive Example 1–3 the relative red shoulder density is lower by 0.15, the relative green shoulder density is approximately unchanged, and the relative blue shoulder density has increased by 0.28. Thus, the overall shoulder density position is improved relative to the comparative examples.

Comparing the unwanted green density for a blue exposure of variation 1-2 to variation 1-1 illustrates the preferred color purity of yellow coupler Y-5 as compared to yellow coupler Y-1.

Example 2

Silver chloride emulsions were chemically and spectrally sensitized as in Example 1.

Coupler dispersions were emulsified by methods well known to the art, and the following layers were coated on polyethylene terephthalate transparent sheet 7 mils in thickness. The gelatin layers were hardened with bis (vinylsulfonyl methyl) ether at 2.4% of the total gelatin weight.

Example 2 includes the following layers, in addition to those previously described in Example 1.

| | g/m$^2$ |
|---|---|
| GL-2: Green Sensitive Layer | |
| Gelatin | 2.1 |
| Green Sensitive Silver | 0.38 |
| M-X | 0.97 |
| 2-(2-butoxyethoxy)ethyl acetate | 0.16 |
| Tri-2-ethylhexyl phosphate | 1.07 |
| Dioctyl hydroquinone | 0.10 |
| 1-Phenyl-5-mercaptotetrazole | 0.001 |
| DYE-2 | 0.006 |
| GL-3: Green Sensitive Layer | |
| Gelatin | 2.1 |
| Green Sensitive Silver | 0.66 |
| M-X | 0.97 |
| 2-(2-butoxyethoxy)ethyl acetate | 0.16 |
| Tri-2-ethylhexyl phosphate | 1.07 |
| Dioctyl hydroquinone | 0.10 |
| 1-Phenyl-5-mercaptotetrazole | 0.001 |
| DYE-2 | 0.006 |
| GL-4: Green Sensitive Layer | |
| Gelatin | 2.1 |
| Green Sensitive Silver | 0.38 |
| M-2 | 0.69 |
| Dibutyl phthalate | 0.62 |
| Octadecyl 3,5-di-tert-butyl-4-hydroxyhydrocinnamnate | 0.07 |
| ST-8 | 0.27 |
| ST-21 | 0.27 |
| ST-22 | 0.46 |

-continued

| | g/m$^2$ |
|---|---|
| 1-Phenyl-5-mercaptotetrazole | 0.001 |
| DYE-2 | 0.006 |
| IL-2: Interlayer | |
| Gelatin | 0.75 |
| Dioctyl hydroquinone | 0.10 |
| Dibutyl phthalate | 0.29 |
| Disodium 4,5 Dihydroxy-*m*-benzenedisulfonate | 0.07 |
| SF-1 | 0.016 |
| Irganox 1076 ™ | 0.015 |
| RL-2 Red Sensitive Layer | |
| Gelatin | 2.30 |
| Red Sensitive Silver (Red EM-1) | 0.72 |
| C-1 | 1.01 |
| Dibutyl phthalate | 0.99 |
| UV-2 | 0.65 |
| 2-(2-butoxyethoxy)ethyl acetate | 0.08 |
| Dioctyl hydroquinone | 0.013 |
| DYE-3 | 0.02 |
| BL-3: Blue Sensitive Layer | |
| Gelatin | 2.92 |
| Blue Sensitive Silver (Blue EM-1) | 0.71 |
| Y-5 | 1.32 |
| Polymer-2 | 1.32 |
| Dibutyl phthalate | 0.90 |
| 2,5-Dihydroxy-5-methyl-3-(1-piperidinyl)-2-cyclopenten-1-one | 0.002 |
| 1-Phenyl-5-mercaptotetrazole | 0.0001 |
| DYE-1 | |
| UV-3: UV Overcoat | |
| Gelatin | 0.81 |
| UV-1 | 0.085 |
| UV-2 | 0.48 |
| Dioctyl hydroquinone | 0.14 |
| Dibutyl phthalate | 0.095 |
| 1,4-Cyclohexylenedimethylene bis(2-ethylhexanoate) | 0.095 |
| S-2: SOC | |
| Gelatin | 1.07 |
| Methacrylate beads | 0.016 |
| Dioctyl hydroquinone | 0.013 |
| Dibutyl phthalate | 0.039 |
| SF-1 | 0.009 |
| SF-2 | 0.004 |

M-X

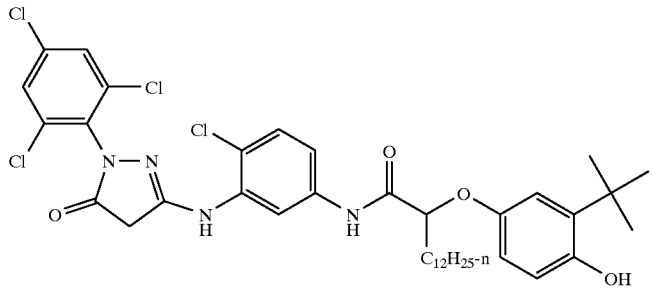

Coatings 2-1 through 2-3 were prepared according to the structure shown in Table 3).

TABLE 3

| Coating | 2-1 | 2-2 | 2-3 |
|---|---|---|---|
| Comment | Comparison | Comparison | Invention |
| SOC | S-2 | S-2 | S-2 |
| UV | UV-3 | UV-3 | UV-3 |
| BL | BL-3 | BL-3 | BL-3 |
| IL | IL-2 | IL-2 | IL-2 |
| RL | RL-2 | RL-2 | RL-2 |
| IL | IL-2 | IL-2 | IL-2 |
| GL | GL-2 | GL-3 | GL-4 |
| DF | DF-1 | DF-1 | DF-1 |

The coatings were given a red, green and blue stepped exposure and processed through the Kodak RA-4 process, described in the *British Journal of Photography Annual* of 1988, pp. 190–199, comprising the following processing solutions, times and temperatures to give the results shown in Table 4.

| | | |
|---|---|---|
| Developer | 110 sec | 35° C. |
| Bleach-Fix | 110 sec | 35° C. |
| Wash | 3 min, 40 sec | 33–34° C. |

TABLE 4

| Coating | Comment | Total Silver Content ($g/m^2$) | Green Shoulder Density | Blue Density at Green Density of 2.00 | Red Density at Green Density of 2.00 |
|---|---|---|---|---|---|
| 2-1 | Comparison | 1.81 | 1.59 | 0.90 | 0.59 |
| 2-2 | Comparison | 2.09 | 2.03 | 0.90 | 0.59 |
| 2-3 | Invention | 1.81 | 2.57 | 0.70 | 0.52 |

Shoulder density refers to the density at 0.6 log exposure units above the speed point. The speed point is defined as the log exposure for a density of 0.8. Minimum density, or D-min, is subtracted from these shoulder densities.

Blue density at a green density of 2.0 refers to the amount of blue density as measured by Status A densitometry for a green light exposure. Red density at a green density of 2.0 refers to the amount of red density as measured by Status A densitometry for a green light exposure. These are both measures of color purity.

As shown in the table, the inventive variation 2-3 has the highest green shoulder density, the least amount of unwanted blue and red density for a green exposure, at low total silver content. Variation 2-1 and 2-2 have unacceptably low green shoulder densities of 1.59 and 2.03 respectively. For a translucent display material, this shoulder density should be 2.5 or greater for highly saturated colors and deep maximum density. Comparing the unwanted blue and red density for a green exposure of variation 2-2 to variation 2-3 illustrates the preferred color purity of magenta coupler M-2 as compared to magenta coupler M-X.

The invention has been described in detail with particular reference to preferred embodiments thereof, but it will be understood that variations and modifications can be effected within the spirit and scope of the invention.

What is claimed is:

1. A color photographic display element comprising a transparent support, a red light sensitive layer comprising a cyan dye forming coupler, a green light sensitive layer comprising a magenta dye forming coupler, a blue light sensitive layer comprising a yellow dye forming coupler, wherein said magenta dye forming coupler comprises

MAGENTA-1

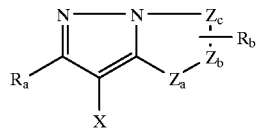

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon—carbon double bond, it may form part of an aromatic ring, and at least one of $Z_a$, $Z_b$, and $Z_c$ represents a methine group connected to the group $R_b$, and wherein said blue light sensitive layer is the light sensitive layer nearest the top of the photographic element and contains an emulsion comprising greater than 90 percent silver chloride, wherein the yellow dye forming coupler comprises

YELLOW-5

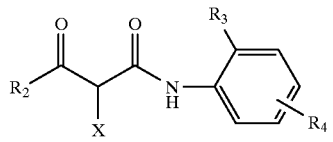

wherein $R_2$ represents a tertiary alkyl group, $R_3$ represents a halogen or an alkoxy substituent, $R_4$ represents a substituent and X represents a N-heterocyclic coupling-off group and wherein the ratio of the edge length of the blue light sensitive emulsion to each of the edge length of the red light sensitive emulsion and the edge length of the green light sensitive emulsion is greater than 1.5.

2. A color photographic element of claim 1 wherein the yellow coupler is as defined in claim 1, and X is represented by the following formula:

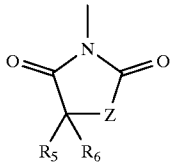

wherein Z is oxygen or nitrogen and $R_5$ and $R_6$ are substituents.

3. A color photographic element of claim 2 wherein the yellow coupler is as defined in claim 2, wherein Z is oxygen and $R_5$ and $R_6$ are alkyl groups.

4. The element of claim 2 wherein said magenta coupler is selected from the group consisting of PZ-1 and PZ-2

PZ-1

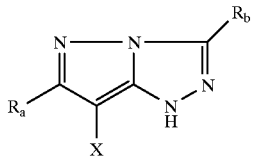

PZ-2

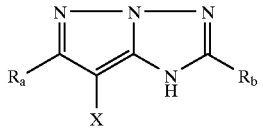

wherein $R_a$ and $R_b$, and X are as defined for MAGENTA-1.

5. The photographic element of claim 4 wherein there are interlayers between said layers containing couplers and said interlayers comprise an oxidized developer scavenger.

6. The element of claim 4 wherein said support comprises a polyester sheet.

7. The element of claim 5 wherein said developer scavenger comprises at least one material selected from the group consisting of hydroquinones, hydrazides, and sulfonamidophenols.

8. The element of claim 5 wherein said developer scavenger comprises 2,5-di-tert-octyl hydroquinone.

9. The element of claim 1 wherein said yellow dye forming coupler comprises

Y-5

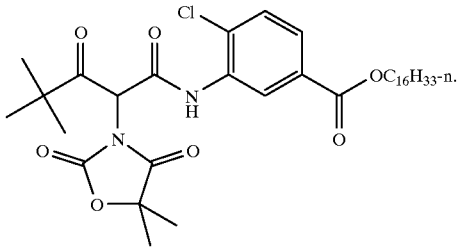

10. The element of claim 9 wherein said magenta coupler comprises

M-2

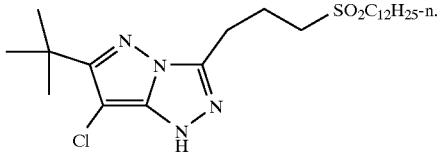

11. The element of claim 1 wherein said magenta coupler comprises

M-2

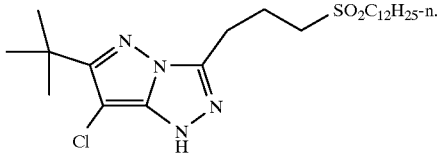

12. The photographic element of claim 1 wherein said emulsion layer comprising the yellow dye forming coupler comprises silver halide grains having an aspect ratio of greater than 2 and comprising greater than 95% silver chloride.

13. The element of claim 1 wherein yellow coupler containing layer also contains a water insoluble latex polymer.

* * * * *